US007157865B2

(12) United States Patent
Fregoso

(10) Patent No.: US 7,157,865 B2
(45) Date of Patent: Jan. 2, 2007

(54) CIRCUIT FOR DRIVING COLD CATHODE TUBES AND EXTERNAL ELECTRODE FLUORESCENT LAMPS

(75) Inventor: Gilbert Fregoso, Hamilton, MT (US)

(73) Assignee: Design Rite LLC, Walnut, CA (US)

( * ) Notice: Subject to any disclaimer, the term of this patent is extended or adjusted under 35 U.S.C. 154(b) by 59 days.

(21) Appl. No.: 11/127,605

(22) Filed: May 11, 2005

(65) Prior Publication Data

US 2005/0253534 A1 Nov. 17, 2005

Related U.S. Application Data

(60) Provisional application No. 60/573,319, filed on May 21, 2004, provisional application No. 60/570,533, filed on May 11, 2004.

(51) Int. Cl.
*H05B 37/02* (2006.01)

(52) U.S. Cl. ..... 315/307; 315/209 R; 315/291; 315/244; 315/118; 315/224; 315/DIG. 5; 315/DIG. 7

(58) Field of Classification Search ..... 315/209 R, 315/209 SC, 200 R, 227 R, 205, 244, 247, 315/224, 291, 307, 312, 112, 118, 318, 324, 315/DIG. 5, DIG. 7
See application file for complete search history.

(56) References Cited

U.S. PATENT DOCUMENTS

| | | | | |
|---|---|---|---|---|
| 5,384,516 | A | 1/1995 | Kawabata et al. | |
| 5,495,405 | A | 2/1996 | Fujimura et al. | |
| 5,615,093 | A * | 3/1997 | Nalbant | 363/25 |
| 5,742,497 | A * | 4/1998 | Hashimoto et al. | 363/133 |
| 5,828,187 | A | 10/1998 | Fischer | |
| 5,854,543 | A | 12/1998 | Satoh et al. | |
| 5,930,121 | A | 7/1999 | Henry | |
| 5,959,412 | A | 9/1999 | Ushijima | |
| 6,008,590 | A * | 12/1999 | Giannopoulos et al. | 315/209 R |
| 6,008,593 | A * | 12/1999 | Ribarich | 315/307 |
| 6,118,221 | A | 9/2000 | Kumasaka et al. | |
| 6,211,623 | B1 | 4/2001 | Wilhelm et al. | |
| 6,400,095 | B1 | 6/2002 | Primisser et al. | |
| 6,525,492 | B1 | 2/2003 | Ribarich | |
| 6,674,250 | B1 * | 1/2004 | Cho et al. | 315/291 |
| 2004/0056610 | A1 | 3/2004 | Fregoso | |
| 2004/0155607 | A1 * | 8/2004 | Rust et al. | 315/291 |

FOREIGN PATENT DOCUMENTS

| | | | |
|---|---|---|---|
| EP | 1 367 864 | A1 | 12/2003 |
| EP | 1 378 883 | A1 | 1/2004 |
| WO | WO 02/33502 | A1 | 4/2002 |

* cited by examiner

*Primary Examiner*—Haissa Philogene
(74) *Attorney, Agent, or Firm*—Jean Kyle

(57) ABSTRACT

A circuit for driving cold cathode tubes and external electrode fluorescent lamps uses only 19–26 watts of power. A steady square wave oscillator generator sets a running frequency for the circuit. A high voltage inductor or high voltage/high frequency transformer in combination with a current limiting capacitor, the lamp and two low resonance value capacitors in series are set and tuned to the oscillation frequency to achieve resonance with the oscillator. The circuit requires an input that has been capacitively and inductively filtered to eliminate harmonic noise in and out of the input line. A thermal shutdown feedback circuit monitors temperature of the circuit. Further, a non-inductive or non-capacitive loading lamp detection feedback and a lamp disconnect driver eliminates false disconnects at start up due to cold bulbs and allows all lamps running on the circuit to continue operation if one is disconnected.

5 Claims, 5 Drawing Sheets

CIRCUIT FOR DRIVING COLD CATHODE TUBES AND EXTERNAL ELECTRODE FLUORESCENT LAMPS

CROSS REFERENCE TO RELATED APPLICATIONS

This application claims the benefits of U.S. Provisional Patent Applications Ser. No. 60/570,533, filed May 11, 2004 and Ser. No. 60/573,319, filed May 21, 2004. The disclosure of these applications are hereby incorporated by reference in their entirety, including all figures, tables, and drawings.

BACKGROUND OF THE INVENTION

Increasing amounts of energy are being consumed everyday while energy costs continue to skyrocket. Recent emphasis on convenience and safety can be attributed to some of the demand for increased energy. For example, vending machines are routinely placed on street corners, in public buildings and near gas stations to conveniently offer their wares anytime of day. Banks now provide access to their services to customers 24 hours a day through Automatic Teller Machines (ATMs). ATMs are well lit to draw attention to their location however it is also important that these ATMs be well lit for safety. Many of these devices are lit with fluorescent lights. Fluorescent lights are also increasingly being used in industrial settings and in the home. Fluorescent lamps use a considerable amount of energy and produce a lot of heat. Further, when these lamps are provided with too much current, light output weakens and becomes irregular. Many circuits have been designed in an attempt to drive fluorescent lamps and cold cathode fluorescent lamps more efficiently (U.S. Pat. Nos. 5,495,405; 5,854,543; 5,930,121; 5,959,412; 6,118,221; and U.S. patent application Publication No. US 2004-0056610 A1). Cold cathode tubes and external electrode fluorescent lamps consume less energy and are more efficient and reliable. Replacing fluorescent lamps with cold cathode tubes or external electrode fluorescent lamps that are driven by an energy efficient circuit would reduce overall energy consumption and save considerable money for many consumers.

All patents, patent applications, provisional patent applications and publications referred to or cited herein, are incorporated by reference in their entirety to the extent they are not inconsistent with the explicit teachings of the specification.

SUMMARY OF THE INVENTION

The invention is a circuit for driving cold cathode tubes (CCFL) and external electrode fluorescent lamps (EEFL) that consumes very little energy. The subject circuit unlike conventional CCFL and EEFL drivers cannot be shifted and therefore is an efficient, reliable driver. A high voltage inductor or a high voltage/high frequency transformer in combination with a current limiting capacitor, the lamp and a low resonance value capacitor are tuned to an oscillation frequency set by a steady state square wave oscillator generator. The circuit has a thermal shutdown feedback circuit to monitor temperature and a lamp detection feedback/lamp disconnect driver to insure the circuit drives the lamps reliably.

DETAILED DESCRIPTION OF INVENTION

The invention is a circuit for driving cold cathode fluorescent lamps (CCFL) and external electrode fluorescent lamps (EEFL) that uses significantly less power then known lamp driving circuits. The circuit can be configured for a single channel or for multiple channels.

Figure 1:
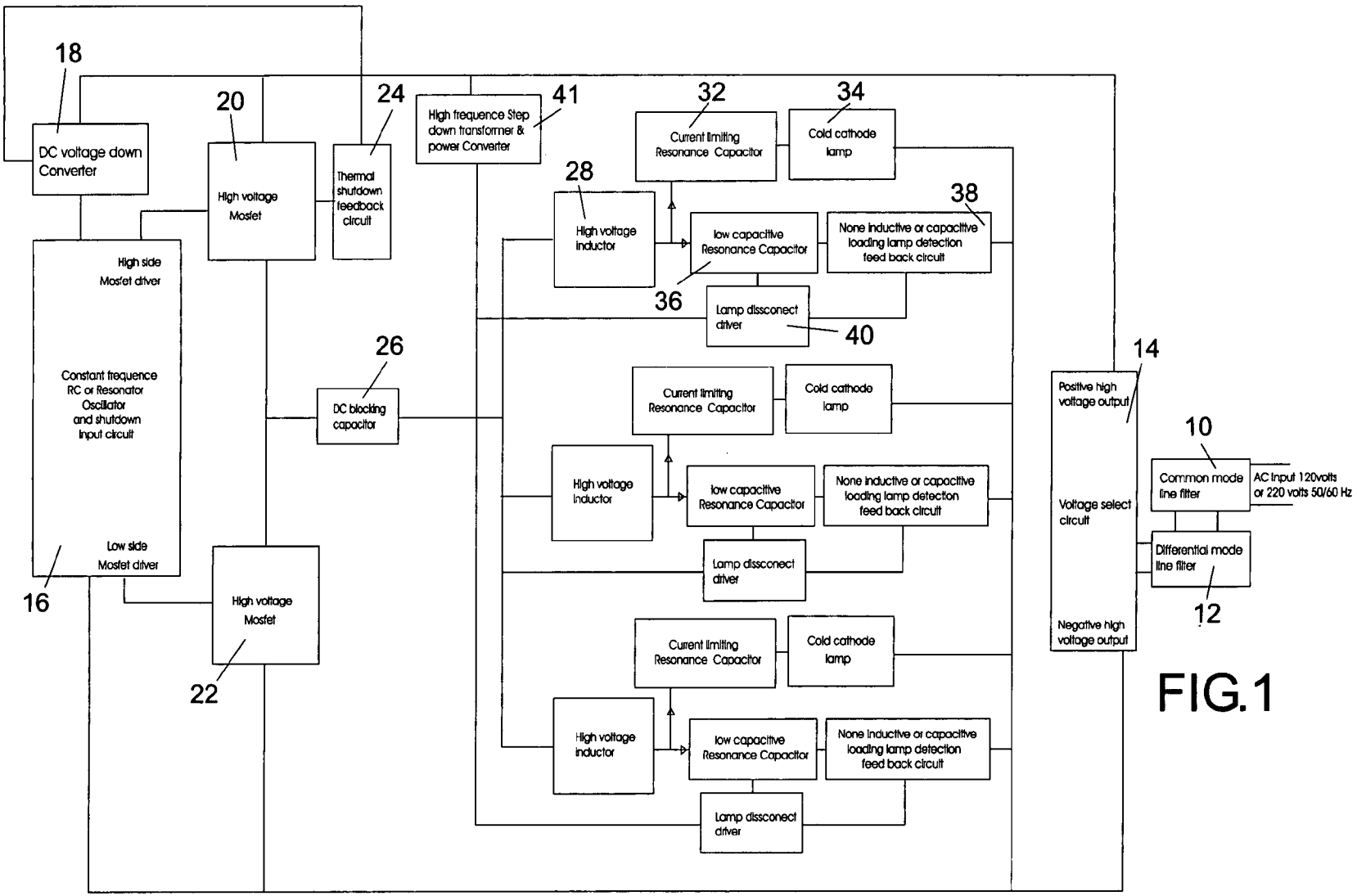
FIG. 1 is a circuit diagram showing a preferred embodiment of the circuit of the subject invention using alternating current input.
Figure 2:
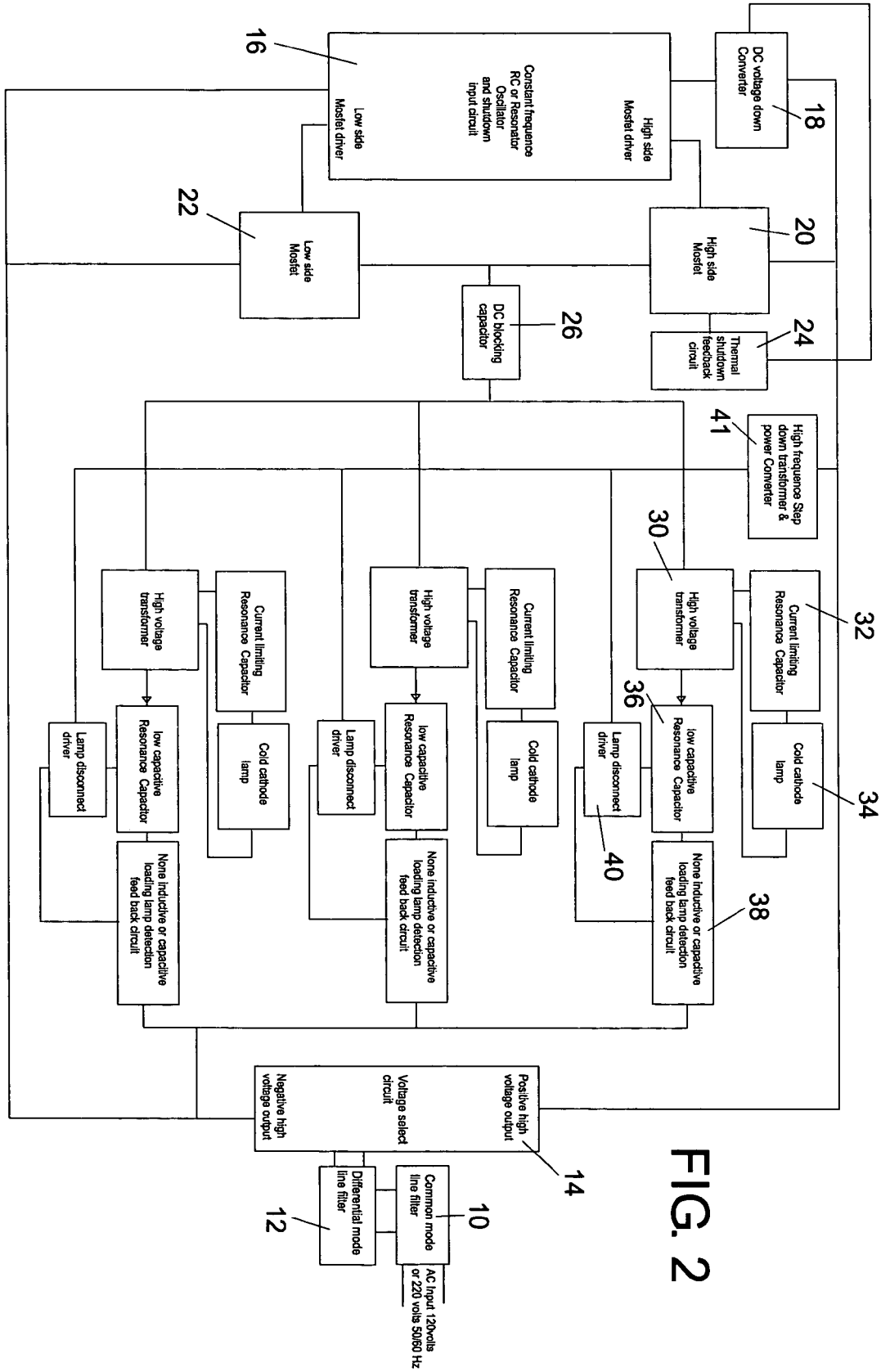
FIG. 2 is a circuit diagram of another preferred embodiment of the circuit of the subject invention using alternating current input.
Figure 3:
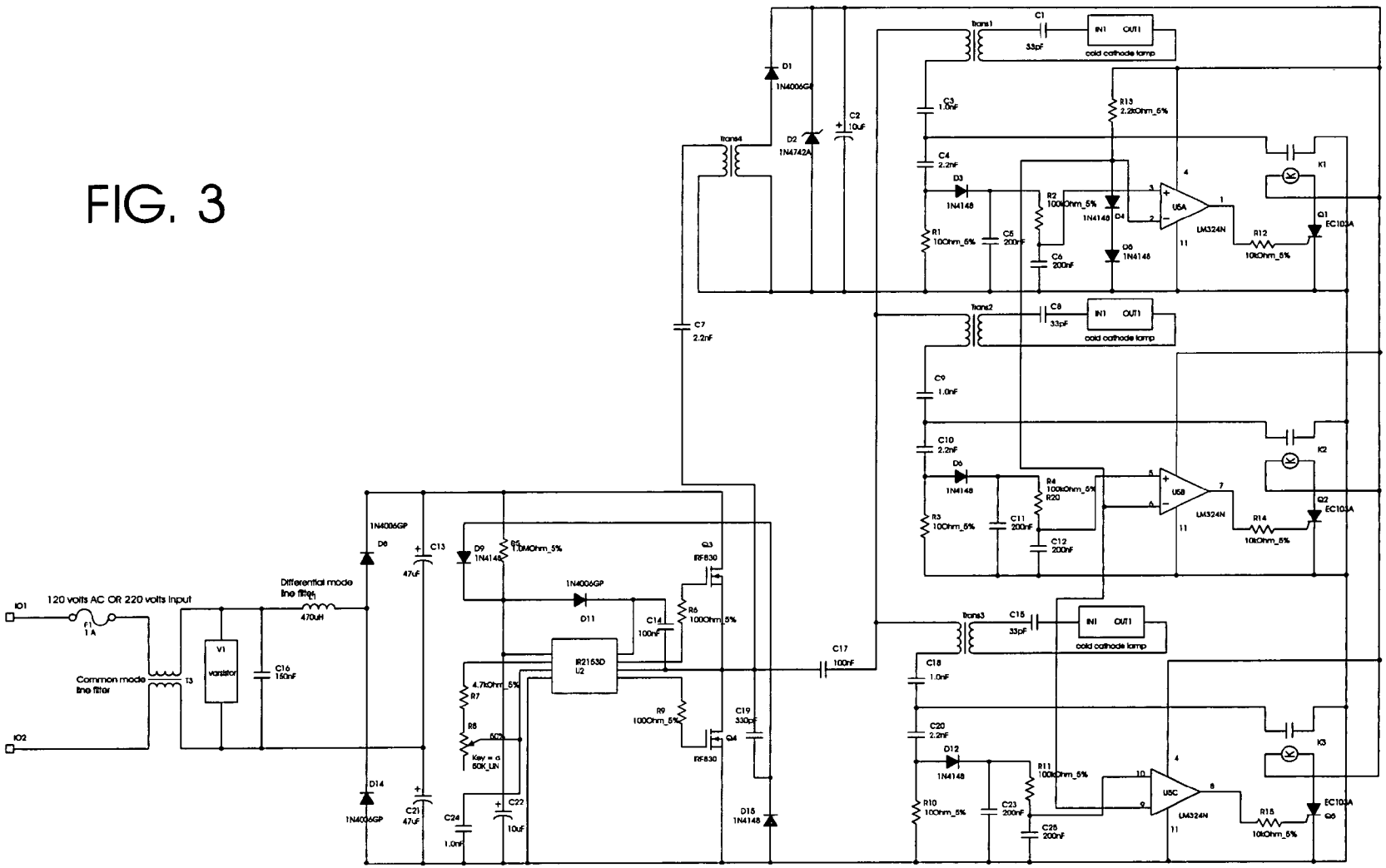
FIG. 3 is a schematic diagram of the preferred embodiment of the circuit shown in FIG. 2.
Figure 4:
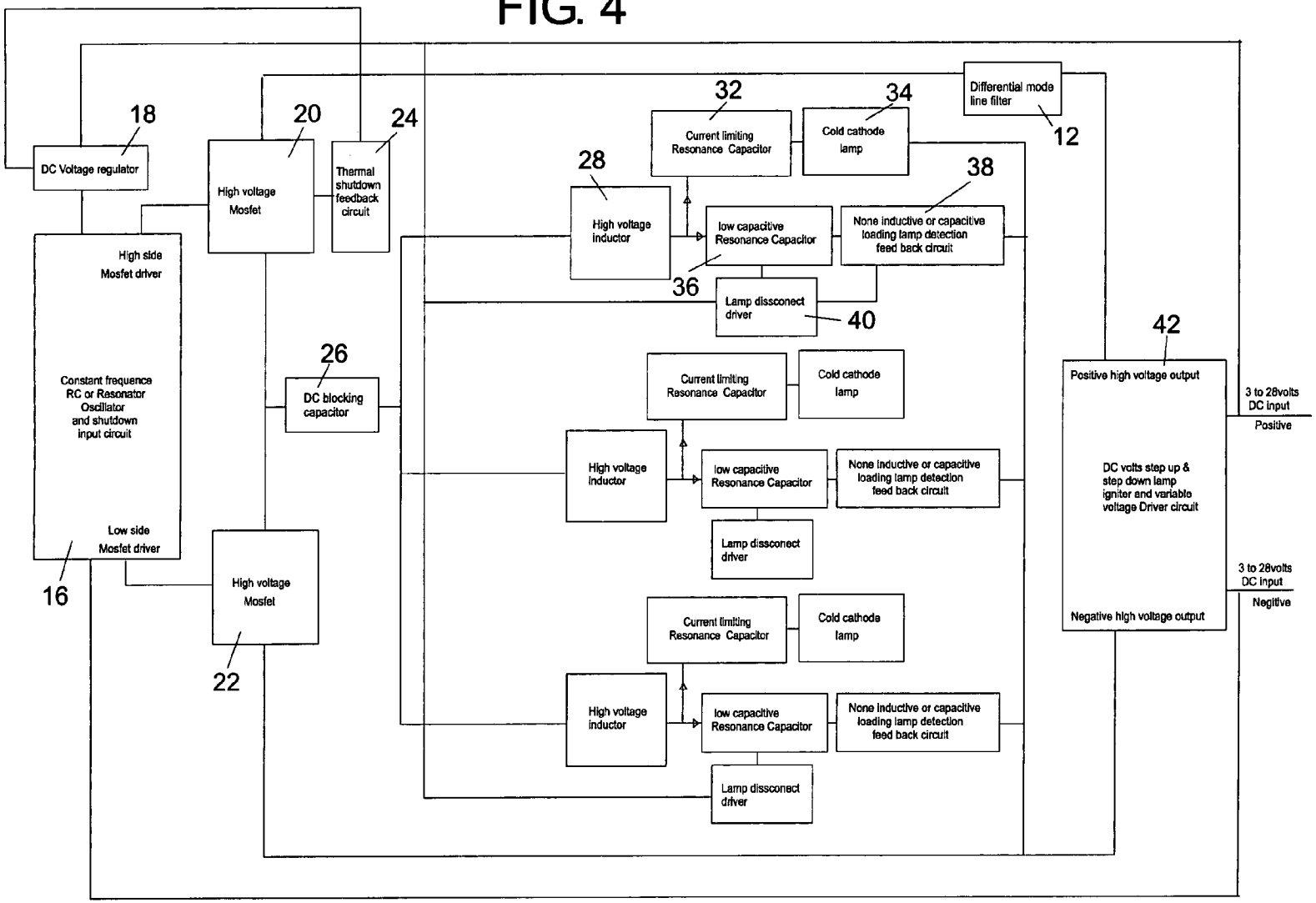
FIG. 4 is a circuit diagram of another preferred embodiment of the circuit of the subject invention using direct current input.
Figure 5:
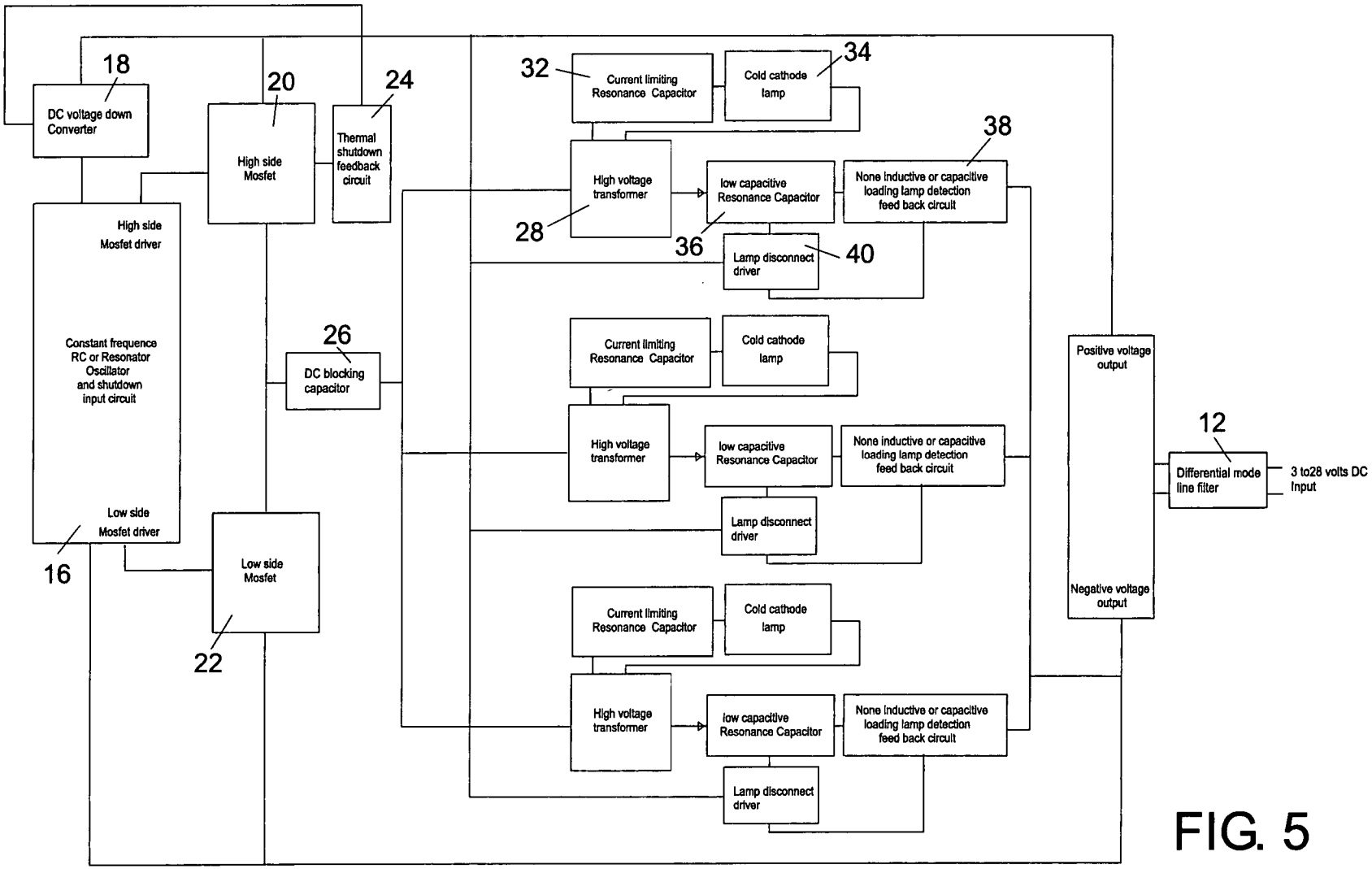
FIG. 5 is a circuit diagram of another preferred embodiment of the circuit of the subject invention using direct current input.

The circuit of the subject invention must be supplied with a clean source of direct current (DC). FIGS. 1–3 show preferred embodiments of the subject circuit powered by alternating current (AC). FIGS. 4–5 show preferred embodiments of the subject circuit powered by DC. One skilled in the art recognizes that there are many ways to obtain a clean DC source. FIG. 3 shows a particularly preferred method for obtaining such a source. The circuit shown in FIG. 3 uses an AC line source of 110 volts (V) or 220 V AC. To clean the input of harmonic noise, the circuit includes a common mode line filter 10, a varsistor, a filter capacitor, a differential line filter 12, two high voltage diodes and three filter capacitors. The common mode line filter and the differential line filter are set to have inductances that suit the running frequency. The varsistor and filter capacitors are set to the AC line voltage. The high voltage diodes are about 700 V. A voltage selection switch 14 allows the circuit to use 110 V or 220 V AC. For the circuit of the subject invention to be effective, it is only necessary that the source be filtered by capacitance and inductance to clean the source of harmonic noise. This can most often be accomplished for DC input with a differential line filter.

A steady state square wave half bridge oscillator generator 16 is used to set a running frequency for the subject circuit. The oscillator generator is preferably an integrated circuit (IC). A DC voltage down converter 18 provides power to the IC at start-up and continues to power the system as the circuit runs. The oscillator generator has a low side and high side outputs for the high side MOSFET 20 and a low side MOSFET 22 which complete a half bridge. The MOSFETs should be high voltage of about, at least, 500 V. The circuit is protected from overheating by a thermal shutdown feedback 24 circuit which monitors the temperature of the power switching MOSFETS and is coupled to one of the heat sinks of a MOSFET. The thermal circuit shuts off the DC power if the circuit overheats.

A DC blocking capacitor 26 insures no DC enters the AC supply rail. The DC blocking capacitor is a high switching ballast inverter, for example, a high frequency, metalized, polypropylene film capacitor is useful in the subject invention. The AC rail supplies one or more channels. A channel comprises a lamp driver and element, a non-inductive or non-capacitive loading lamp detection feedback and a lamp disconnect driver. The lamp driver and element include a high voltage inductive device with a current limiting resonance capacitor 32, the lamp unit 34 and a low resonance value capacitor 36 two which are in series are set and tuned to the oscillation frequency of the oscillator generator to achieve resonance. The high voltage inductive device can be a high voltage inductor 28 or a high voltage/high frequency transformer 30. The high voltage inductor's inductance must be calculated for the running frequency and has a dielectric breakdown strength of least 2000 V root mean square. The high voltage/high frequency transformer has turns calculated for the inductance to suit the running frequency, a core that will not saturate and a turn ratio defined and tuned for the frequency and output voltages. In an exemplified embodiment the running frequency was set at 43 kilohertz (KHz). This frequency was chosen because it achieves optimum lamp brightness in the chosen lamp while using little power. A standard circuit to drive a compact fluorescent lamp uses 120 watts. The circuit shown in FIG. 1 uses only 28 watts. This circuit however uses a less efficient high voltage inductor to boost voltage. A more preferred embodiment of the circuit of the subject invention is shown in FIGS. 2 and 3. In this embodiment, a high voltage/high frequency transformer is used to achieve the necessary voltage. The transformer is more efficient than the inductor and thus the circuit uses only 19 watts.

Each channel of the subject circuit further includes a non-inductive or non-capacitive loading lamp detection feedback 38 and a lamp disconnect driver 40. This lamp feedback/disconnect prevents false disconnects at start-up due to cold bulbs. The lamp detection feedback comprises a current sensing resistor which is a low resistance element to minimize loss, a fast recovery diode to convert power to DC, a filter, a resistor/capacitor (RC) buffer circuit, a voltage comparator and a latching silicon control rectifier (SCR). The voltage comparator is powered by a high frequency step down transformer and power converter 41 and provides a fixed reference point that addresses each channel. The lamp disconnect driver is a low input voltage/low current relay that is a mechanical device for disconnecting the lamp upon a signal from the lamp detection feedback. This insures that if one lamp is disconnected, the single lamp is shut off and the remainder of the lamps on the rail will continue to run. The disconnect driver further disconnects the entire channel eliminating all power to the channel which prevents the user from being shocked. The circuit also eliminates noise from the disconnected channel.

The subject circuit is reliable since it runs at a constant frequency and cannot be shifted. The exemplified embodiments show the circuit of the subject invention driving three channels and lamps. It is important to note the circuit effectively drives one and more than three channels. The lamps do not flicker. The thermal shutdown circuit prevents the circuit from failing, burning the circuit case, a fire risk and destroying the circuit. The lamp detection feedback and lamp disconnect driver prevent premature lamp disconnect and automatically reconnect and refire the lamps in the event of power loss or lightening strike.

FIGS. 4 and 5 show alternative embodiments of the circuit of the subject invention. In these embodiments, there is a DC source input. The circuit is simpler in that it is unnecessary to convert from AC to DC input. The circuit in FIG. 4 uses an initial DC voltage step up and step down lamp igniter and variable driver circuit 42 to step-up the voltage. The lamp igniter is a high frequency up/down power converter that converts line voltage to maximize the efficiency of the conversion. A high voltage inductor 28 in the lamp driver provides the final voltage increase. The circuit in FIG. 5 has a high voltage/high frequency step-up transformer 30 in the lamp driver which makes an additional voltage step-up unnecessary.

It is understood that the foregoing examples are merely illustrative of the present invention. Certain modifications of the articles and/or methods employed may be made and still achieve the objectives of the invention. Such modifications are contemplated as within the scope of the claimed invention.

The invention claimed is:

1. A circuit for driving cold cathode fluorescent lamps and external electrode fluorescent lamps comprising:

a steady state square wave half bridge oscillator generator to set a running frequency with a high side and low side output;

a high side MOSFET and a low side MOSFET to complete the half bridge;

a direct current down voltage converter to power the oscillator generator and half bridge;

a direct current blocking capacitor;

a thermal shutdown feedback circuit to monitor the temperature of one of the high side MOSFET and the low side MOSFET;

a channel comprising:

a lamp driver and element comprising: a high voltage inductive device; a current limiting capacitor; a lamp; and at least two low resonance value capacitors in series;

a non-inductive or non-capacitive loading lamp detection feedback comprising: a current sensing resistor; a fast recovery diode; a filter; a resistor/capacitor buffer circuit; a voltage comparator; and a latching silicon control rectifier; and a lamp disconnect driver, wherein the power input for the circuit has been cleaned of harmonic noise.

2. The circuit of claim 1, wherein said inductive device is a high voltage inductor.

3. The circuit of claim 1, wherein said inductive device is a high voltage/high frequency transformer.

4. The circuit of claim 1, wherein said input is alternating current and said circuit further comprises: a common mode line filter, a varsistor, a filter capacitor, a differential line filter, two high voltage diodes and three filter capacitors.

5. The circuit of claim 1, wherein said input is direct current and said circuit further comprises: a differential line filter.

* * * * *